US005757731A

United States Patent [19]

Rosenberg

[11] Patent Number: 5,757,731

[45] Date of Patent: May 26, 1998

[54] LINEAR DIGITAL-ANALOG INTERACTIVE WRISTWATCH

[76] Inventor: Burton A. Rosenberg, 1053 Marina Heights Rd., Brookings, Oreg. 97415

[21] Appl. No.: 160,291

[22] Filed: Nov. 19, 1993

[51] Int. Cl.[6] ..... G04C 17/00

[52] U.S. Cl. ..... 368/242; 368/223; 368/84

[58] Field of Search ..... 368/240–242, 368/239, 82, 83, 84, 223

[56] References Cited

U.S. PATENT DOCUMENTS

| | | | |
|---|---|---|---|
| 2,221,413 | 11/1940 | Schanz . | |
| 2,226,138 | 12/1940 | Prestinari | 58/88 |
| 2,333,832 | 11/1943 | Torroja . | |
| 3,574,992 | 4/1971 | Ladas | 58/50 |
| 3,772,874 | 11/1973 | Lefkowitz . | |
| 3,823,551 | 7/1974 | Riehl | 58/23 R |
| 3,956,879 | 5/1976 | Bailey | 58/2 |
| 3,968,639 | 7/1976 | Berets | 58/23 |
| 3,973,706 | 8/1976 | Boyce | 224/4 D |
| 3,977,176 | 8/1976 | Murakami | 58/23 BA |
| 4,015,422 | 4/1977 | Van Haaten | 368/281 |
| 4,103,484 | 8/1978 | Bailey | 58/125 C |
| 4,161,098 | 7/1979 | Ingendahl | 58/2 |
| 4,194,355 | 3/1980 | Nishida | 368/282 |
| 4,204,399 | 5/1980 | Heynisch | 368/240 |
| 4,242,747 | 12/1980 | Fahrenschon | 368/242 |
| 4,270,196 | 5/1981 | Terzian | 368/82 |
| 4,271,497 | 6/1981 | Terzian | 368/82 |
| 4,323,996 | 4/1982 | Ganter | 368/88 |
| 4,357,691 | 11/1982 | Goodchild | 368/62 |
| 4,397,565 | 8/1983 | Ota | 368/242 |
| 4,435,046 | 3/1984 | Nishimura | 350/334 |
| 4,483,628 | 11/1984 | Terzian | 368/82 |
| 4,575,833 | 3/1986 | Bakhtiari | 368/282 |
| 4,690,567 | 9/1987 | Rebeaud | 368/203 |
| 4,752,919 | 6/1988 | Clark | 368/223 |
| 4,991,154 | 2/1991 | Perucci | 368/223 |
| 4,995,015 | 2/1991 | Chiang | 368/11 |
| 5,051,968 | 9/1991 | Calabrese | 368/76 |

FOREIGN PATENT DOCUMENTS

| | | | |
|---|---|---|---|
| 2185816 | 1/1974 | France . | |
| 2813234 | 10/1979 | Germany . | |
| 4241316 | 6/1983 | Germany . | |
| 3318801 | 11/1984 | Germany . | |
| 57-6380 | 1/1982 | Japan . | |
| 115893 | 6/1985 | Japan | 368/242 |
| 281339 | 12/1964 | Netherlands | 368/232 |
| 2052809 | 1/1981 | United Kingdom . | |

OTHER PUBLICATIONS

Academic American Enclyclopedia P 62 9Century Prior Art.

*Primary Examiner*—Bernard Roskoski
*Attorney, Agent, or Firm*—Milton M. Field

[57] ABSTRACT

A wristwatch linear time display (32) is disclosed which can be read at a glance and requires very little display space. Additional functions are described which use the remaining surplus display space. These functions substantially increase the usefulness of wristwatches. Devices for the wearer to interact with the added functions are disclosed.

The compact time display (32) may be located where it can be seen without turning a wrist. It may also be combined with other temporal displays to improve display clarity by eliminating clutter.

19 Claims, 3 Drawing Sheets

LINEAR DIGITAL-ANALOG INTERACTIVE WRISTWATCH

BACKGROUND OF THE INVENTION

This invention relates to wristwatch display of information providing the time, display showing other than the time, and the interaction of the wearer with the displays unrelated to time.

Conventional analog watches with hands can be read at a glance if accuracy is not desired. Conventional digital watches povide accuracy but do not graphically show the current moment's position in the time span. Watches with both analog and digital displays require the wearer to ignore the digital display when glancing and observe both displays when accuracy is desired.

Analog watches with hands use almost all of the display space available. Adding digital and calendar data display to them substantially detracts from their clarity. Digital watches with multiple displays are cluttered. Those with calculator and memo functions increase the clutter to the degree that concentration is required when looking for the time.

Diversional displays presenting random shapes are not available. Game displays for the wearer to interact with are not available. Data processing is not available. Data transfer with external storage during wearer interaction with the display is not available.

OBJECTS AND ADVANTAGES OF THE INVENTION

It is the general object of this invention to make it possible to add useful functions to wristwatches. This has been done by improving the time display and decreasing the space required to display it. This improved compact time display is the prerequisite for the following objectives:

1. To provide display space for games and other amusements with random action that the wearer can interact with.

2. To provide: Display space for data and data processing.

Watchband data and energy storage.

A receptacle for connecting to external storage.

3. To provide an interactive control keyboard that fits within the limited space available on a wristwatch with a large display.

4. To provide a time display that the wearer can see without turning a wrist.

5. To provide additional temporal displays alongside the basic time display in an uncluttered and easily read arrangement.

These objects substantially increase the services a wristwatch supplies to the wearer in addition to simplifying the reading of time. Further objects and advantages of my invention will become apparent from a consideration of the drawings and ensuing description.

SUMMARY

This simple idea of displaying an indicator that traverses a linear path each hour, and thereby shows the time remaining in an hour at a glance, provides the opportunity to increase the usefulness of a wristwatch. A digital time display in line with the linear hourly traverse display supplies accuracy in the smallest possible space.

This compact linear time display can be located along one side of the display surface or on the periphery of the watchcase. It can be seen by the wearer without turning a wrist if it is located on the periphery facing the wearer. The remaining unused display surface is available for other displays.

If no additional display is desired the linear time display with a narrow watchband provides the minimum in wristwatch size. Adding a parallel linear analog hour display and a parallel linear analog day display eliminates the clutter evident on current watches with multiple displays.

The compact size of the linear time display makes it possible to provide practical wearer watch interaction since the display and keyboard space required for it is available. Some of the functions that can be added are:

Entertainment- games, aphorisms, activities.

Business & technology- data display & storage, computing.

Travel- dictionaries, schedules, names, exchange rates.

Random action displays with provisions for the wearer to interact with them are possible. Watchband data storage, devices to use it, and a receptacle to connect with external stores are provided.

BRIEF DESCRIPTION OF THE DRAWINGS

This invention will be described in more detail by way of example, with reference to the accompanying drawings in which.

REFERENCE NUMERALS IN DRAWINGS

Figure 1:
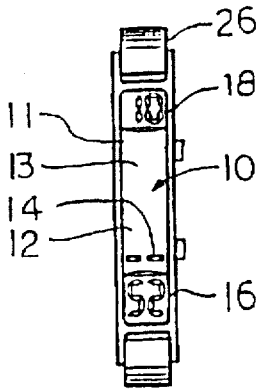
FIG. 1 is a plan view of the simplest embodiment of a linear digital-analog wristwatch.

8 watch face
9 watch face periphery
10 compact time display
11 surround
12 analog hour progress display
13 route
14 Analog hourly minute indicator 16 Minute digits
18 Hour digits
19 Second linear display
20 Day name
21 Third linear display
22 Day number
24 Month
26 Watchband
28 Nontemporal display
30 Random display
32 Sloped surface
34 Display screen
36 Key
37 Sloped key surface
38 Keyboard
40 Mode key
42 External connector receptacle
44 Watchband storage
46 Minute index mark
48 Temporal display
50 Key identification
52 Interactive wearer watch control key
54 Cover

DESCRIPTION

FIG. 1 is a plan view of the simplest of the embodiments showing a wristwatch having a watch face 8 containing a relatively narrow compact time display 10, enclosed by a surround or border 11 and including a digital time display provided as hour digits 18 and minute digits 16 at opposite ends of and in line with an analog hour progress display 12. The analog hour progress display 12 includes an analog hour progress indicator 14 which moves along a substantially straight route 13 from one end to the other end of the analog progress display 12. As seen in the figure, analog hour progress indicator 14 is close to the end of its traverse from the hour digits 18 to the minute digits 16. The space between it and the minute digits shows the portion of the hour remaining. Indicator 14 in the liquid crystal display shown moves from electrode to electrode in steps. All of the displayed steps can be retained if desired. Bar graph displays are available if preferred. Accuracy is supplied with the minute digits. The LCD alphanumeric displays can be switched to seconds or calendar display when desired. As seen in the figure, indicator 14 has a dimension traverse to route 13. Hour digits 18 and minute digits 16 adjoin analog progress display 12 at opposite ends thereof and have substantially the same dimension as indicator 14 transverse to route 13.

Figure 2:
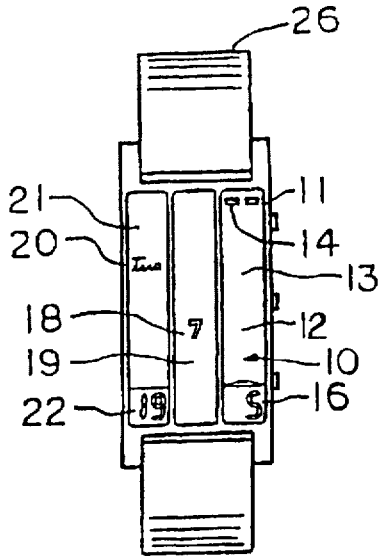
FIG. 2 is a plan view of an uncluttered multiple display embodiment of a linear digital-analog wristwatch.

FIG. 2 is a plan view of a multiple display linear digital-analog wristwatch. The hour progress display 12 includes route 13 and an indicator 14, which traverses along route 13 as described for FIG. 1. The hour digit 18 display is no longer aligned with analog hour progress display 12, but traverses along a second linear display 19 from top to bottom every twelve hours, thereby continuously displaying the current hour and the portion of the day that has elapsed and the portion that remains. A day of the week display 20 similarly traverses along a third linear display 21. The date is shown digitally below the day. The linear watch displays the progression of the week in an orderly uncluttered manner.

The linear displays shown are straight. They can be curved in an arc, an "S" shape, or free form for aesthetic reasons or for conformance with the watchcase. The reduction in space required is the same.

Figure 3:
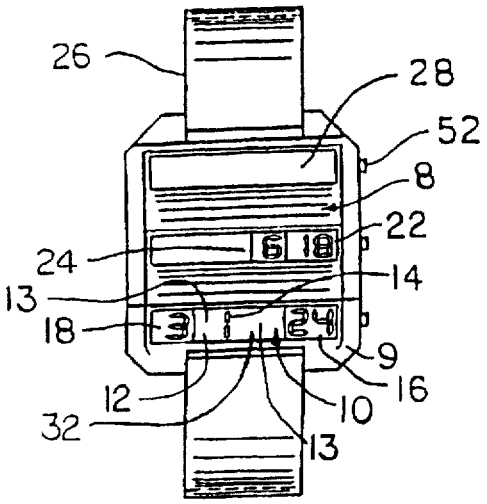
FIG. 3 is a plan view of a multiple function display embodiment of a linear digital-analog interactive wristwatch.

FIG. 3 is a plan view of a multiple display linear digital-analog interactive wristwatch. Compact time display 10 is positioned on a sloped surface 32, adjoins a portion of the periphery 9 of watch face 8 at one side thereof and extends over only a minor portion of the watch face. This makes the remaining major portion of the watch face, which is unencumbered by compact time display 10, available for other functions as shown at 24 and 28. The displays in this view are foreshortened because they are not parallel with the plane of the view. The time display 10 is readable even though it is foreshortened. The nontemporal display 28 space is clearly not needed for time display.

Figure 4:
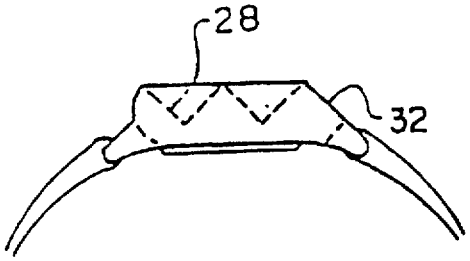
FIG. 4 is a side view of the watch of FIG. 3 showing one longitudinal edge of the linear time display 32 raised up.

FIG. 4 is a side view of the watch of FIG. 3. The time display on slope 32 is on the periphery of the watch where it faces the wearer without turning a wrist. All of the displays are placed at 45 degrees. The angle chosen is optional.

Figure 5:
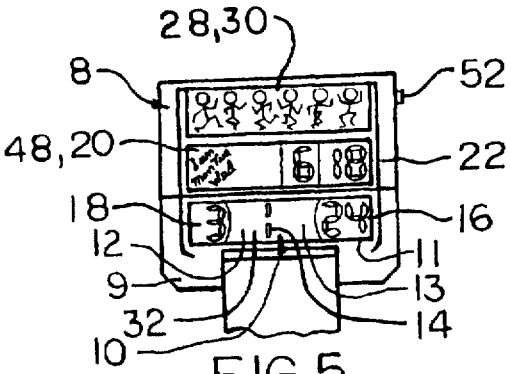
FIG. 5 is the wearer's view of the watch of FIG. 3 without turning a wrist.

FIG. 5 is the wearer's view of the watch of FIG. 3. The bottom display shows the time display on slope 32 with the analog hour progress indicator 14 traversing the space between the hour digit 18 and the and the minute digits 16. The simplicity of this time display is most apparent here. You have it if you separate the hours 18 from the minutes 16 in a conventional digital display and use the blinking colon as the traversing hour progress indicator 14.

The center temporal display 48 shows the day, month, and date. It can be a second nontemporal display 28 or added to the top nontemporal display 28 since the complete time display on slope 32 is provided below it.

The dancers in the top display appear at random; singly or in multiples. Their limbs can move by switching electrodes in an LCD. The wearer can alter tempo, rhythm, or the sequence of appearance with an interactive control 52. Basketball displays can be provided with interactive blocking and sinking of shots.

Figure 6:
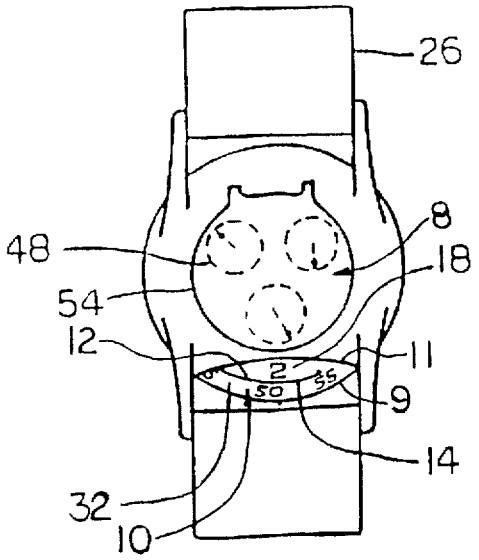
FIG. 6 is a plan view of a mechanical wristwatch embodiment of a linear digital-analog watch.

FIG. 6 is a plan view of a compact time display 10, incorporating analog hour progress display 12 adjoining digital hour display 18 and digital minute display 16, on a mechanical wristwatch. The ancillary temporal display 48 such as day, date, and seconds are under a flip up cover 54. The analog hour progress indicator 14, an arc, is clearly visible as is the hour digit 18. Compact time display 10 adjoins a portion of the periphery 9 of the watch face 8 at one side thereof and extends over only a minor portion of the watch face. This makes the remaining major portion of the watch face, which is unencumbered by compact time display 10, available for other functions, such as the ancillary temporal display 48.

The peripherally located linear digital-analog time display can be included as an additional feature on a conventional analog wristwatch. A roulette wheel can be put under the cover.

Figure 7:
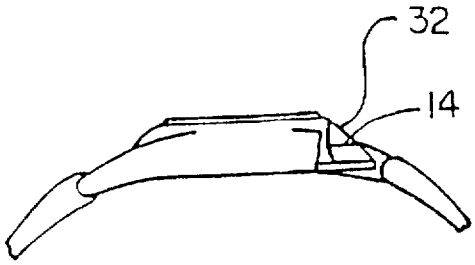
FIG. 7 is a side view of the watch of FIG. 6 showing the linear time display 32 on the periphery facing the wearer. One of the watchbands retaining brackets is partially deleted for clarity.

FIG. 7 is the side view of the watch of FIG. 6 showing the peripherally located time display on slope 32. The display is less exposed to damage and is therefore a better choice than conventional watches for those wearers who are physically active. A protective ridge or hood above the display can be added to further decrease the chance of damage.

Figure 8:
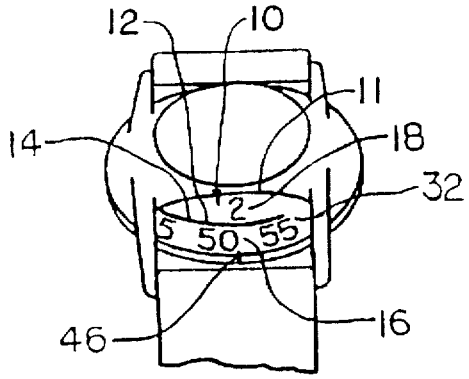
FIG. 8 is the wearer's view of the watch of FIG. 6 with the wrist unturned.

FIG. 8, the wearer's view of the watch of FIG. 6, shows the hour digit 18 centered in the display. The hour display 18 moves in jumps of an hour. Several mechanisms are available to do this.

The analog hour progress indicator 14 can visually standout by contrast and color from the background display so that it can be read at a glance. The minute index mark 46 is used for accuracy. The mechanical drive for the coned disks bearing the time display on slope 32 present no challenge for anyone familiar with mechanical time pieces.

Figure 9:
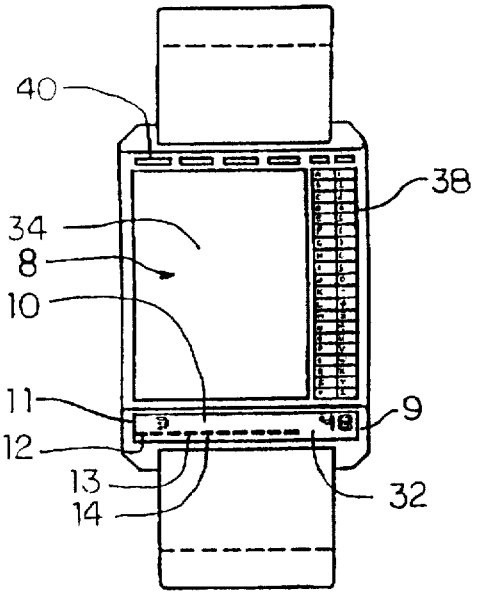
FIG. 9 is a plan view of the preferred embodiment of a linear digital-analog interactive wristwatch.

FIG. 9 is the preferred embodiment of the linear digital-analog interactive wristwatch. The relatively narrow compact time display 10 is located horizontally on sloped surface 32 and comprises analog hour progress display 12 having analog hour progress indicator 14 extending across straight route 13, which extends from one end of compact time display 10 to the other end thereof. Digital hour display 18 and digital minute display 16 adjoin analog hour progress display 12 and are positioned just above route 13 so that the effective width of compact time display 10 is established by the combined height of indicator 14 and digital displays 18 and 16. Compact time display 10 adjoins the lower side of the periphery 9 of the watch face 8 and extends over only a minor portion of the watch face, the remaining major portion of the watch face being unencumbered by compact time display 10 and being available for other functions.

These include a keyboard 38, a display screen 34, and mode keys 40. The keyboard 38 has the full alphabet, ten digits, and +−×+. Mode keys 40 can switch keys to different functions. Other mode keys can input and access storage, actuate remote storage, and set the time. The time display on slope 32 in this plan view is foreshortened but still readable.

Figure 10:
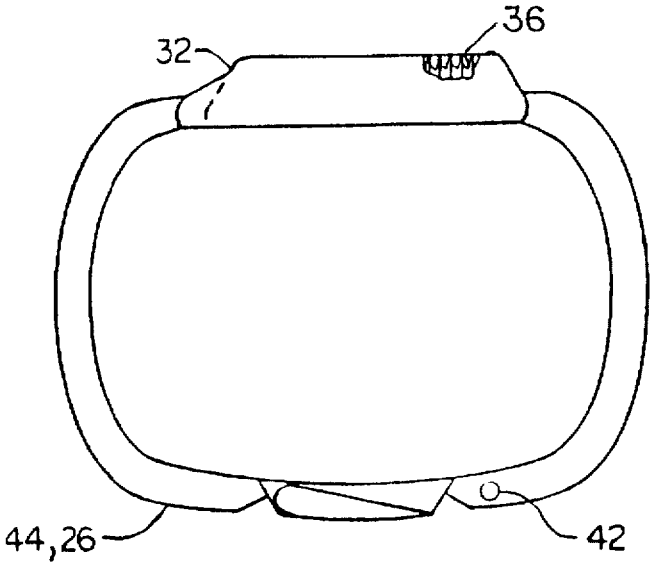
FIG. 10 is a side view of the watch of FIG. 9 showing a side cutout view of the keyboard keys, watchband storage, and a receptacle for connection to external data and energy storage.

FIG. 10 is a side view of the watch of FIG. 9. The time display on slope 32 is located on the periphery of the watchcase facing the wearer. The watchband 26 shown would be custom fitted to the wearer. The data storage can also be contained in small packets attached to a conventional watchband. The external connector receptacle 42 is shown.

Figure 11B:
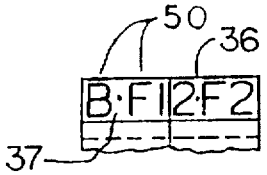
FIG. 11A is an enlarged side view and 11B a wearer's view of the keys of the watch of FIG. 10.
Figure 11A:
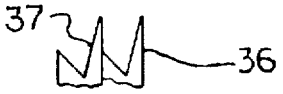

FIG. 11A and FIG. 11B show the recessed keys 36 of the watch of FIG. 9. The keys are designed to be depressed with a pointed probe inserted into the recess shown. Keys 36 have a sloped surface 37 on which key identification 50 is located above the probe's contact point to prevent wear from decreasing legibility. By placing key identification 50 on sloped key surface 37, the area of the watch face needed for the identification of the keys is reduced. The higher location is also more visible to the wearer. Keys 36 with more than one identification have dual functions which are activated with mode keys 40. There are forty input keys 36 shown and four mode keys. This provides the potential for 160 different inputs. The interactive performance of the wearer with the watch during data processing is substantially enhanced by using a pointed probe and recessed keys. Data processing on a wristwatch is impractical without them.

Figure 12:
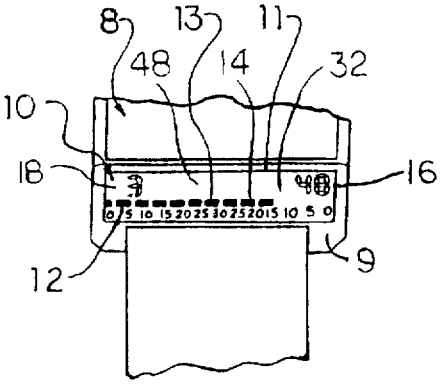
FIG. 12 is the wearer's view of the watch of FIG. 9 with the wrist unturned.

FIG. 12 shows the wearer's view of the time display 32 on the watch of FIG. 9. The analog hour progress indicator 14 is a series of dashes in this display. There is space above the dashes to momentarily show calendar data 48.

While my above description contains many specificities, these should not be construed as limitations on the scope of the invention, but rather as an exemplification of the embodiments thereof. Many other variations are possible. For example, the mechanical watch of FIG. 6 can have an LCD linear time display as described herein on the periphery facing the wearer. Accordingly, the scope of the invention should be determined not by the embodiments illustrated, but by the appended claims and their legal equivalents.

What is claimed is:

1. A wristwatch comprising a watch face having a periphery, said watch face including a relatively narrow compact time display, and controls means for controlling said compact time display, said compact time display comprising:

A. a digital time display which presents the current hour and minute in spaced digits in response to said control means, and B. a linear hour progress display adjoining and between said spaced digits, said display including a substantially straight defined route having a beginning and an end with an indicator in it, said indicator starting at said beginning of said substantially straight route at the beginning of each hour and moving at an unchanging rate of speed to said end of said substantially straight route in the course of each hour, thereby continuously displaying the portion of each hour that has elapsed and the portion remaining in response to said control means, said compact time display adjoining a portion of said periphery at one side of said watch face and extending across only a minor portion of said watch face, the remaining major portion of said watch face being unencumbered by said compact display and available for other functions.

2. The wristwatch of claim 1, wherein said current hour and minute digits are at respective ends of and aligned with said substantially straight route.

3. The wristwatch of claim 2, wherein said indicator has a dimension transverse to said defined route and wherein said hour and minute digits have substantially the same dimension as said indicator in a direction transverse to said defined route.

4. The wristwatch of claim 3, wherein the width of said narrow compact display comprises said dimension transverse to said route.

5. A wristwatch of claim 1, further including in said remaining major portion an auxiliary data display screen and a plurality of actuating keys.

6. The wristwatch of claim 5, wherein said keys comprise a sloped surface, said symbols being located on said sloped surface, thereby reducing the watch face space required for key identification.

7. A wristwatch comprising a time display and control means for controlling said time display, said time display comprising, A. a display which presents the current minute in digits in response to said control means, B. a linear hour progress display, said display including a substantially straight defined route having a beginning and an end with an indicator in it, said indicator starting at said beginning of said substantially straight route at the beginning of each hour and moving at an unchanging rate of speed to said end of said substantially straight route in the course of each hour, thereby continuously displaying the portion of each hour that has elapsed and the portion remaining in response to said control means, and C. a second linear display having a beginning and an end showing hour digits sequentially displayed in steps that proceed from said beginning of said second linear display to said end of said display thereby continuously displaying the current hour and the portion of the day that has elapsed and the portion that remains.

8. A wristwatch comprising a time display and control means for controlling said time display, said time display comprising, A. a display which presents the current minute in digits in response to said control means, B. a linear hour progress display including a substantially straight defined route having a beginning and an end with an indicator in it, said indicator starting at said beginning of said substantially straight route at the beginning of each hour and moving at an unchanging rate of speed to said end of said substantially straight route in the course of each hour, thereby continuously displaying the portion of each hour that has elapsed and the portion remaining in response to said control means, wherein said linear hour progress display has one raised longitudinal edge to make said display visible to the wearer without turning a wrist.

9. A wristwatch comprising a time display and control means for controlling said time display, said time display comprising, A. a display which presents the current minute in digits in response to said control means, B. a linear hour progress display including a substantially straight defined route having a beginning and an end with an indicator in it, said indicator starting at said beginning of said substantially straight route at the beginning of each hour and moving at an unchanging rate of speed to said end of said substantially straight route in the course of each hour, thereby continuously displaying the portion of each hour that has elapsed and the portion remaining in response to said control means, wherein said linear hour progress display is located on a periphery of said wristwatch at an angle so that it is visible to the wearer without turning a wrist.

10. A wristwatch comprising a watch face having a periphery, said watch face including a relatively narrow compact time display, and controls means for controlling said compact time display, said compact time display comprising, A. a digital time display which presents the current hour and minute in spaced digits in response to said control means, and B. a linear hour progress display adjoining said spaced digits, said display including a substantially straight defined route having a beginning and an end with an indicator in it, said indicator starting at said beginning of said substantially straight route at the beginning of each hour and moving at an unchanging rate of speed to said end of said substantially straight route in the course of each hour, thereby continuously displaying the portion of each hour that has elapsed and the portion remaining in response to said control means, said compact time display adjoining a portion of said periphery at one side of said watch face and extending across only a minor portion of said watch face, the remaining major portion of said watch face being unencumbered by said compact display and available for other functions; and said wristwatch further including in said remaining major portion a data display screen with a plurality of actuating keys adjacent to each other, said keys being adjacent to said compact time display and to said screen, a recessed pocket in each actuating key for retaining the pointed end of a probe used to depress said keys, thereby eliminating the need for finger space between said keys, and further including identification symbols on said keys located above said recessed pocket, whereby contact wear will not affect legibility.

11. A wristwatch comprising a watch face having a periphery, said watch face including a relatively narrow compact time display, and controls means for controlling said compact time display, said compact time display comprising, A. a digital time display which presents the current hour and minute in spaced digits in response to said control means, and B. a linear hour progress display adjoining said spaced digits, said display including a substantially straight defined route having a beginning and an end with an indicator in it, said indicator starting at said beginning of said substantially straight route at the beginning of each hour and moving at an unchanging rate of speed to said end of said substantially straight route in the course of each hour, thereby continuously displaying the portion of each hour that has elapsed and the portion remaining in response to said control means, said compact time display adjoining a portion of said periphery at one side of said watch face and extending across only a minor portion of said watch face, the remaining major portion of said watch face being unencumbered by said compact display and available for other functions; wherein said narrow compact display extends with its longitudinal dimension adjoining a horizontal portion of said periphery as viewed by a user, wherein said defined route extends from one end of said narrow compact display to the other end thereof parallel to said horizontal portion of said periphery, and wherein said hour and minute digits are spaced a substantial distance apart and are positioned proximate to and on one side of said defined route, the height of said narrow compact time display being established by the sum of the width of said defined route and the height of said digits.

12. A wristwatch comprising a watch face having a periphery, said watch face including a compact time display and control means for controlling said compact time display, said compact time display comprising:

A. a digital time display which presents the current hour and minute in spaced digits in response to said control means, and B. a linear hour progress display adjoining and between said spaced digits including a substantially linear defined route having a beginning and an end with an indicator in it, said indicator starting at said beginning of said substantially linear route at the beginning of each hour and moving at an unchanging rate of speed to said end of said substantially linear route in the course of each hour, thereby continuously displaying the portion of each hour that has elapsed and the portion remaining in response to said control means, said compact time display adjoining a portion of said periphery at one side of said watch face facing the wearer and extending across only a minor portion of said watch face, the remaining major portion of said watch face being unencumbered by said compact display and available for other functions.

13. A wristwatch comprising a watch face having a substantially rectangular periphery, a time display on said watch face and control means for controlling said time display, said time display being a relatively narrow compact time display occupying substantially all of said watch face and adjoining said rectangular periphery on all sides, said compact time display comprising:

A. a digital time display which presents the current hour and minute in spaced digits in response to said control means, and B. a linear hour progress display adjoining and between said spaced digits and including a substantially straight defined route having a beginning and an end with an indicator in it, said indicator starting at said beginning of said substantially straight route at the beginning of each hour and moving at an unchanging rate of speed to said end of said substantially straight route in the course of each hour, thereby continuously displaying the portion of each hour that has elapsed and the portion remaining in response to said control means, said current hour and minute digits being aligned with said substantially straight route.

14. The wristwatch of claim 13, wherein said indicator has a dimension transverse to said defined route and wherein said hour and minute digits have substantially the same dimension as said indicator in a direction transverse to said defined route.

15. The wristwatch of claim 14, wherein the width of said narrow compact display comprises said dimension transverse to said route.

16. A wristwatch comprising a watch face having a periphery, said watch face including a relatively narrow compact time display, and controls means for controlling said compact time display, said compact time display comprising;

A. a digital time display which presents the current hour and minute in spaced digits in response to said control means, and B. a linear hour progress display adjoining said spaced digits and said display including a substantially straight defined route having a beginning and an end with an indicator in it, said indicator starting at said beginning of said substantially straight route at the beginning of each hour and moving at an unchanging rate of speed to said end of said substantially straight route in the course of each hour, thereby continuously displaying the portion of each hour that has elapsed and the portion remaining in response to said control means, said compact time display adjoining a portion of said periphery at one side of said watch face and extending across only a minor portion of said watch face, the remaining major portion of said watch face being unencumbered by said compact display and available for other functions and said linear hour progress display extending between at least one of said spaced digits adjoining one of said beginning and said end of said route and said other of said beginning and said end, said linear hour progress display and said at least one spaced digit adjoining said periphery.

17. A wristwatch comprising a watch face having a periphery, said watch face including a relatively narrow compact time display, and controls means for controlling said compact time display, said compact time display comprising, A. a digital time display means which presents the current hour and minute in spaced digits in response to said control means, and B. a linear hour progress display means adjoining said spaced digits, said display means including a substantially straight defined route having a beginning and an end with an indicator in it, said indicator starting at said beginning of said substantially straight route at the beginning of each hour and moving at an unchanging rate of speed to said end of said substantially straight route in the course of each hour, thereby continuously displaying the portion of each hour that has elapsed and the portion remaining in response to said control means, said compact time display adjoining a portion of said periphery at one side of said watch face and extending across only a minor portion of said watch face, the remaining major portion of said watch face being unencumbered by said compact display and available for other functions; wherein one of said display means has one side adjoining said portion of said periphery and another side opposite to said one side, wherein said one display means lies between said other display means and said portion of said periphery, and wherein said other display means adjoins said other side of said one display means.

18. The wristwatch of claim 17, wherein said one display means is said linear hour progress display means, and wherein said portion of said periphery is a horizontal portion as viewed by a user, wherein said defined route extends parallel to said horizontal portion of said periphery and wherein said hour and minute digits are positioned proximate to and on said another side of said defined route, the height of said narrow compact time display being established by the sum of the width of said defined route and the height of said digits.

19. A wristwatch comprising a watch face having a periphery, said watch face including a relatively narrow compact time display having relatively long sides lengthwise thereof, and means for controlling said time display, said compact time display comprising:

A. a digital time display which presents the current hour and minute in space digits in response to said control means, and B. a linear hour progress display adjoining said spaced digits, said display including a substantially straight defined route having a beginning and an end with an indicator in it, said indicator starting at said beginning of said substantially straight route at the beginning of each hour and moving at an unchanging rate of speed to said end of said substantially straight route in the course of each hour, thereby continuously displaying the portion of each hour that has elapsed and the portion remaining in response to said control means, said compact time display being positioned to place one of its relatively long sides adjoining a portion of said periphery at one side of said watch face and extending across only a minor portion of said watch face from said one side, leaving a substantial major portion of said watch face unencumbered by said compact display and available for other functions, said remaining major portion being of sufficient size that at least one additional display function is located therein.

* * * * *